US008210879B2

(12) United States Patent
Yash et al.

(10) Patent No.: US 8,210,879 B2
(45) Date of Patent: Jul. 3, 2012

(54) DIELECTRIC COMPONENT AND AN ELECTRICAL CONNECTOR ASSEMBLY INCORPORATING THE SAME

(75) Inventors: Michael Yash, Milford, MI (US); Yeong Taur Eow, Singapore (SG); Tommy Tan Chin Yaw, Singapore (SG)

(73) Assignee: J. S. T. Corporation, Farmington Hills, MI (US)

( * ) Notice: Subject to any disclaimer, the term of this patent is extended or adjusted under 35 U.S.C. 154(b) by 49 days.

(21) Appl. No.: 12/869,057

(22) Filed: Aug. 26, 2010

(65) Prior Publication Data

US 2012/0052732 A1 Mar. 1, 2012

(51) Int. Cl.
*H01R 24/00* (2011.01)

(52) U.S. Cl. ..... 439/626; 439/79; 439/943

(58) Field of Classification Search ..... 439/626, 439/79, 943, 693, 934, 942, 634, 629
See application file for complete search history.

(56) References Cited

U.S. PATENT DOCUMENTS

| | | | | |
|---|---|---|---|---|
| 4,380,361 | A * | 4/1983 | Asick et al. | 439/358 |
| 4,469,387 | A * | 9/1984 | McHugh | 439/140 |
| 4,857,017 | A * | 8/1989 | Erk | 439/695 |
| 5,672,064 | A * | 9/1997 | Provencher et al. | 439/79 |
| 5,743,765 | A * | 4/1998 | Andrews et al. | 439/607.1 |
| 6,319,075 | B1 * | 11/2001 | Clark et al. | 439/825 |
| 7,722,366 | B2 * | 5/2010 | Yamamoto et al. | 439/79 |

* cited by examiner

*Primary Examiner* — Hae Moon Hyeon
(74) *Attorney, Agent, or Firm* — Rader, Fishman & Grauer PLLC

(57) ABSTRACT

A dielectric component is fabricated from a dielectric material and includes a base panel member and a plurality of isolation panel members. The base panel member has a first base panel member surface. The plurality of isolation panel members is connected to and projects perpendicularly from the first base panel member surface. The plurality of isolation panel members are disposed apart from and extend parallel to one another to form a plurality of isolation channels. An electrical connector assembly includes an electrical connector housing and the dielectric component. Consecutive ones of a plurality of terminal pin portions projecting from the electrical connector housing are isolated from one another by consecutive ones of the plurality of isolation panel members such that the terminal pin portions are disposed in the isolation channels and are therefore isolated from one another. The electrical connector assembly might also incorporate a printed circuit board.

18 Claims, 16 Drawing Sheets

DIELECTRIC COMPONENT AND AN ELECTRICAL CONNECTOR ASSEMBLY INCORPORATING THE SAME

FIELD OF THE INVENTION

The present invention relates to a dielectric component for an electrical connector assembly.

BACKGROUND OF THE INVENTION

Electrical connector assemblies are well known in the art and are used in many industries. As an example, the automobile industry uses electrical connector assemblies. In the past, performance requirements for electrical connector assemblies were not very demanding because, in older vehicles, these electrical connector assemblies carried low voltage and/or low amperage. In modern vehicles, higher performance requirements for electrical connector assemblies are now demanded. Modern vehicles use electrical connector assemblies not only for the operation of the vehicle itself but also for equipment ancillary to its operation. Ancillary equipment includes entertainment equipment such as high fidelity stereo equipment and liquid crystal television screens for passenger enjoyment. As a result, the electrical connector assemblies must now carry higher voltages and/or higher amperage.

An electrical connector assembly includes an electrical connector housing and a plurality of terminal pins arranged in a juxtaposed manner to one another. Electrical connector assemblies are often molded using plastic as the mold material. When removed from the mold, one portion of each terminal pin is enveloped by molded plastic to secure the terminal pins in the electrical connector housing and another portion of each terminal pin projects from a generally flat surface of the electrical connector housing. With some types of electrical connector assemblies, the terminal pin portions of the terminal pins are exposed to one another in an open-air environment even when connected to its mating component. Being in this open-air environment, electrical arching might occur between juxtaposed ones of these terminal pin portions resulting in detrimental effects to the electrical circuit. Now, with electrical connector assemblies being designed to carry higher voltage and/or higher amperage, it is believed that the incidence of electrical arching might increase.

To inhibit electrical arching between juxtaposed ones of the terminal pin portions in this open-air, a conformal coating can be applied onto these terminal pin portions thereby covering the same. As a result, the juxtaposed terminal pin portions are now considered isolated from one another thereby improving the dielectric characteristics of the electrical connector assembly thus inhibiting electrical arching.

It would be beneficial to provide a dielectric component for an electrical connector assembly in order to enhance the dielectric characteristics of the electrical connector assembly. It would also be beneficial to provide a dielectric component for the electrical connector assembly to inhibit electrical arching between juxtaposed ones of terminal pins projecting from an electrical connector housing. The present invention provides these benefits.

It would be beneficial to provide a dielectric component for an electrical connector assembly in order to enhance the dielectric characteristics of the electrical connector assembly. It would also be beneficial to provide a dielectric component for the electrical connector assembly to inhibit electrical arching between juxtaposed ones of terminal pins projecting from an electrical connector housing. The present invention provides these benefits.

OBJECTS AND SUMMARY OF THE INVENTION

It is an object of the invention to provide a dielectric component for an electrical connector assembly to enhance its dielectric characteristics.

It is another object of the invention to provide a dielectric component for the electrical connector assembly to inhibit electrical arching between juxtaposed ones of terminal pins projecting from an electrical connector housing.

Accordingly, one exemplary embodiment of a dielectric component of the present invention is hereinafter described. The dielectric component of the present invention includes a base panel member and a plurality of isolation panel members. The base panel member is fabricated from a dielectric material and has a first base panel member surface and an opposite second base panel member surface extending parallel to the first base panel member surface. The plurality of isolation panel members is also fabricated from a dielectric material and is connected to and projects perpendicularly from either the first base panel member surface, the second base panel member surface or both the first base panel member surface, the second base panel member surface. The plurality of isolation panel members are disposed apart from and extending parallel to one another to form a plurality of isolation channels. Respective ones of the plurality of isolation channels are defined as being between the base panel member and consecutive ones of the plurality of isolation panel members. The dielectric component might also include a plurality of stop panel segments. Respective ones of the plurality of stop panel segments are disposed in respective ones of the plurality of isolation channels and could be connected to and between the base panel member and respective, consecutive ones of the plurality of isolation panel members.

Another embodiment of an electrical connector assembly of the present invention includes an electrical connector housing and the dielectric component described above. The electrical connector housing has a plurality of terminal pins secured therein. Each terminal pin has a terminal pin portion that projects from the electrical connector housing. The plurality of terminal pins are arranged in a manner such that, when the electrical connector housing and the dielectric component contact each other, respective ones of the terminal pin portions are received in respective ones of the plurality of isolation channels resulting in consecutive ones of the terminal pin portions being isolated from one another by consecutive ones of the plurality of isolation panel members disposed therebetween.

Yet another embodiment of an electrical connector assembly of the present invention includes both of the electrical connector housing and the dielectric component described above and a printed circuit board. The plurality of terminal pins are arranged in a manner such that, when the electrical connector housing and the dielectric component contact each other, respective ones of the terminal pin portions are received in respective ones of the plurality of isolation channels with consecutive ones of the terminal pin portions being isolated from one another by consecutive ones of the plurality of isolation panel members disposed therebetween. The printed circuit board includes a dielectric component hole and a plurality of terminal pin holes that are formed therethrough. The dielectric component hole is sized and configured to slidably receive the base panel member and the plurality of isolation panel members in an insertion direction.

Respective ones of the plurality of terminal pin holes are sized and arranged to slidably receive respective ones of the terminal pin portions. And, with the dielectric component being hole slidably received by the dielectric component hole and the plurality of terminal pin portions being slidably received by respective ones of the plurality terminal pin holes, the plurality of stop panel segments contact the printed circuit board so that the dielectric component rests on the printed circuit board such that a first part of the dielectric component projects from one side of the printed circuit board, a second part of the dielectric component projects from an opposite side of the printed circuit board and a third part of the dielectric component, disposed between the first and second parts of the dielectric component, is surrounded by the printed circuit board.

These objects and other advantages of the present invention will be better appreciated in view of the detailed description of the exemplary embodiments of the present invention with reference to the accompanying drawings, in which:

DETAILED DESCRIPTION OF THE EXEMPLARY EMBODIMENTS

Hereinafter, embodiments of the present invention will be described with reference to the attached drawings. The structural components common to those of the prior art and the structural components common to respective embodiments of the present invention will be represented by the same symbols and repeated description thereof will be omitted.

A first exemplary embodiment of a dielectric component 10 of the present invention is hereinafter described with reference to FIGS. 1-6. As shown in FIGS. 1-6, the dielectric component 10 includes a base panel member 12 and a plurality of isolation panel members 14. The dielectric component 10 extends along and about a Cartesian x-y-z coordinate system as shown in FIGS. 1-6. As conventionally known in the art, the x axis, the y axis and the z axis intersect at a point P and extend perpendicularly to one another to define an x-y plane, a y-z plane and a x-z plane. The base panel member 12 is fabricated from a dielectric material such as resin, plastic or other type of dielectric material known in the art. The base panel member 12 has a first base panel member surface 12*a* and an opposite second base panel member surface 12*b* that extends parallel to the first base panel member surface 12*a*. By way of example only and not by way of limitation, the base panel member 12 includes a pair of opposing corner notches 12*c*.

Figure 1:
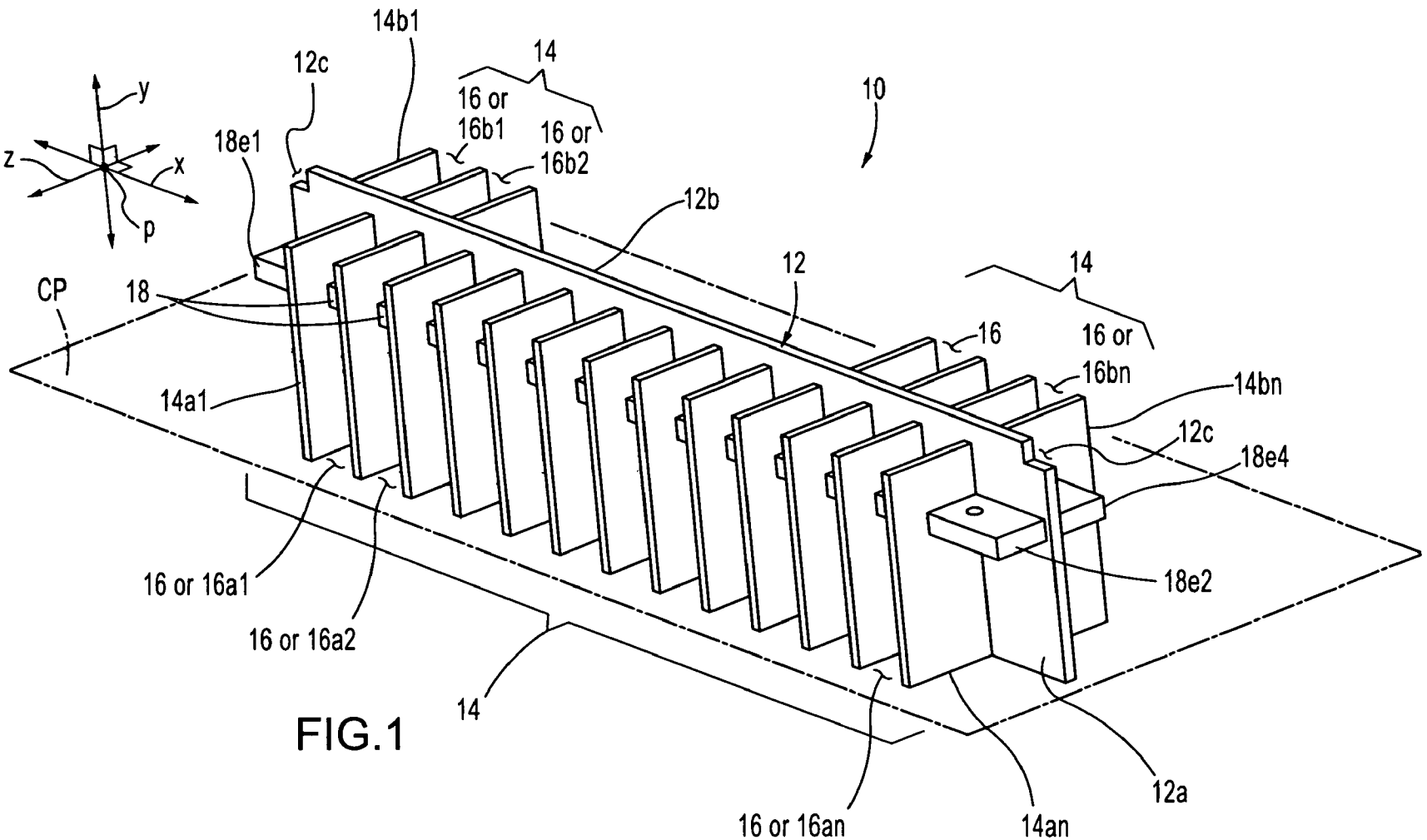
FIG. 1 is a perspective view of a first exemplary embodiment of a dielectric component of the present invention.
Figure 2:
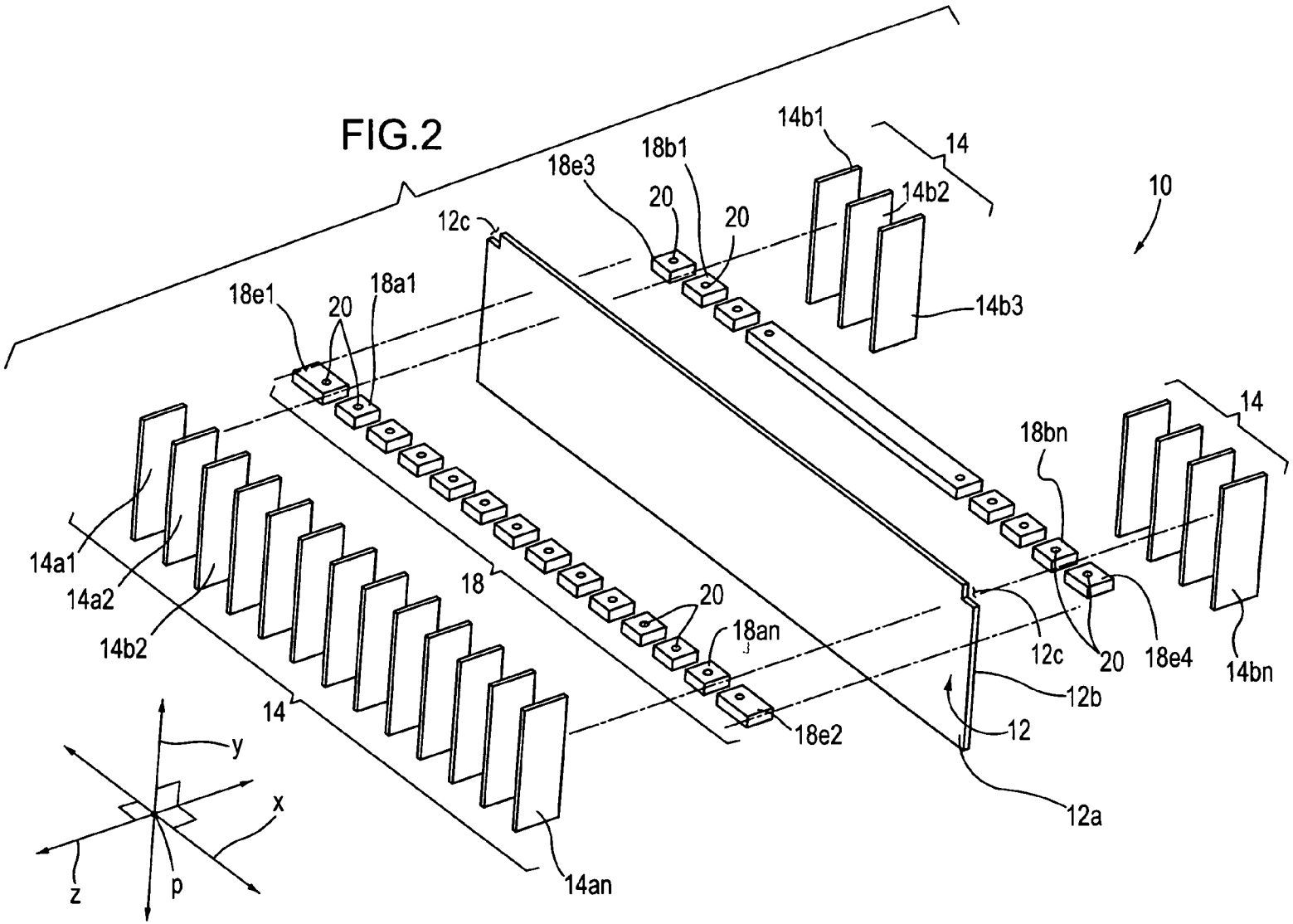
FIG. 2 is an exploded perspective view of the first exemplary embodiment of the dielectric components of the present invention.
Figure 3:
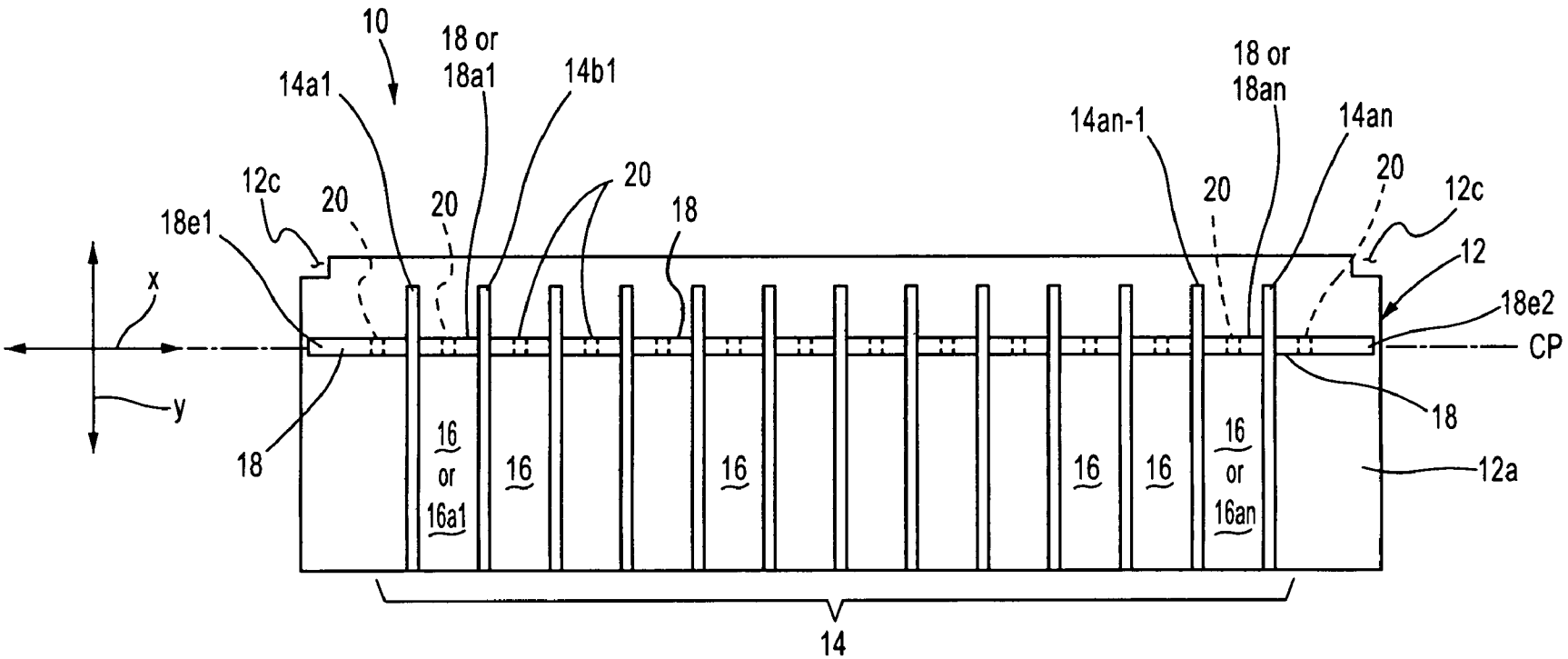
FIG. 3 is a front elevation view of the first exemplary embodiment of the dielectric component of the present invention illustrated in FIG. 1.
Figure 4:
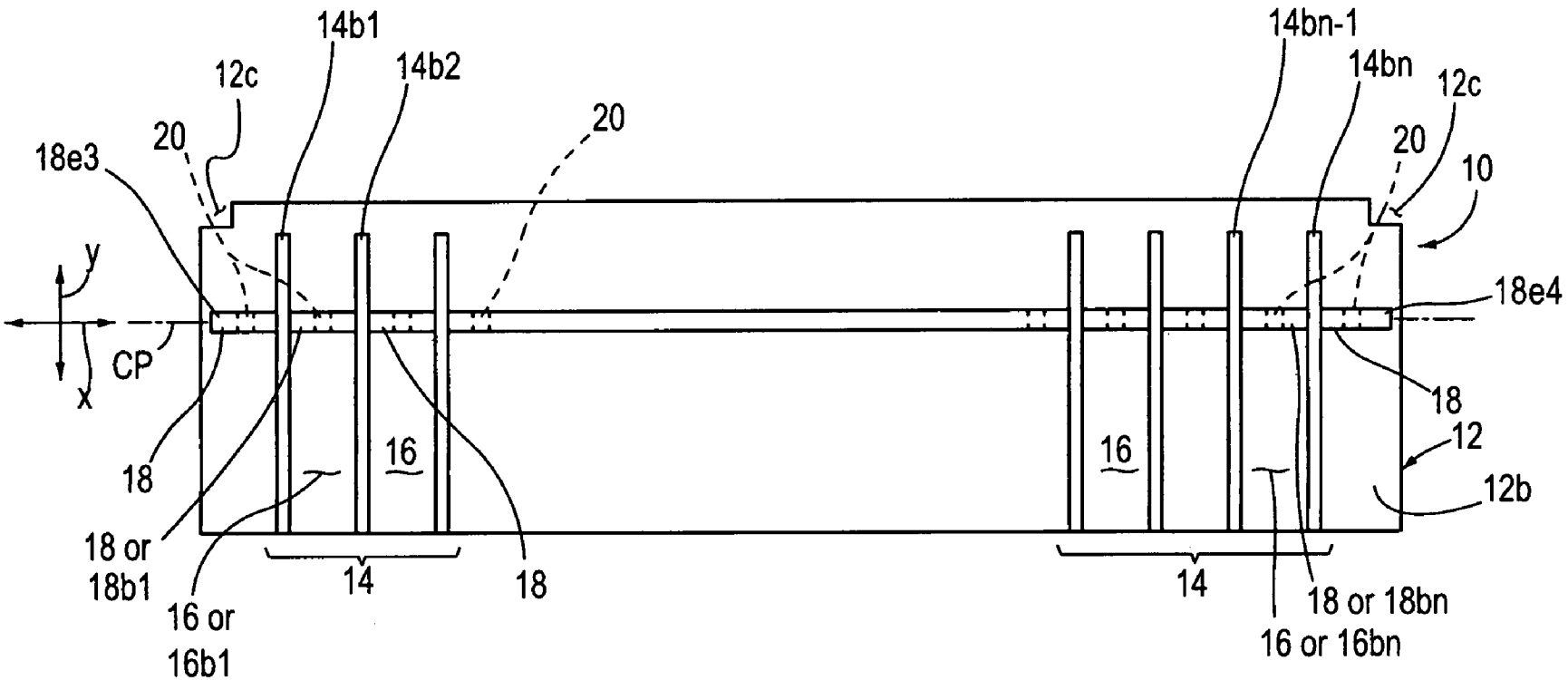
FIG. 4 is a rear elevation view of the first exemplary embodiment of the dielectric component of the present invention illustrated in FIG. 1.
Figure 5:
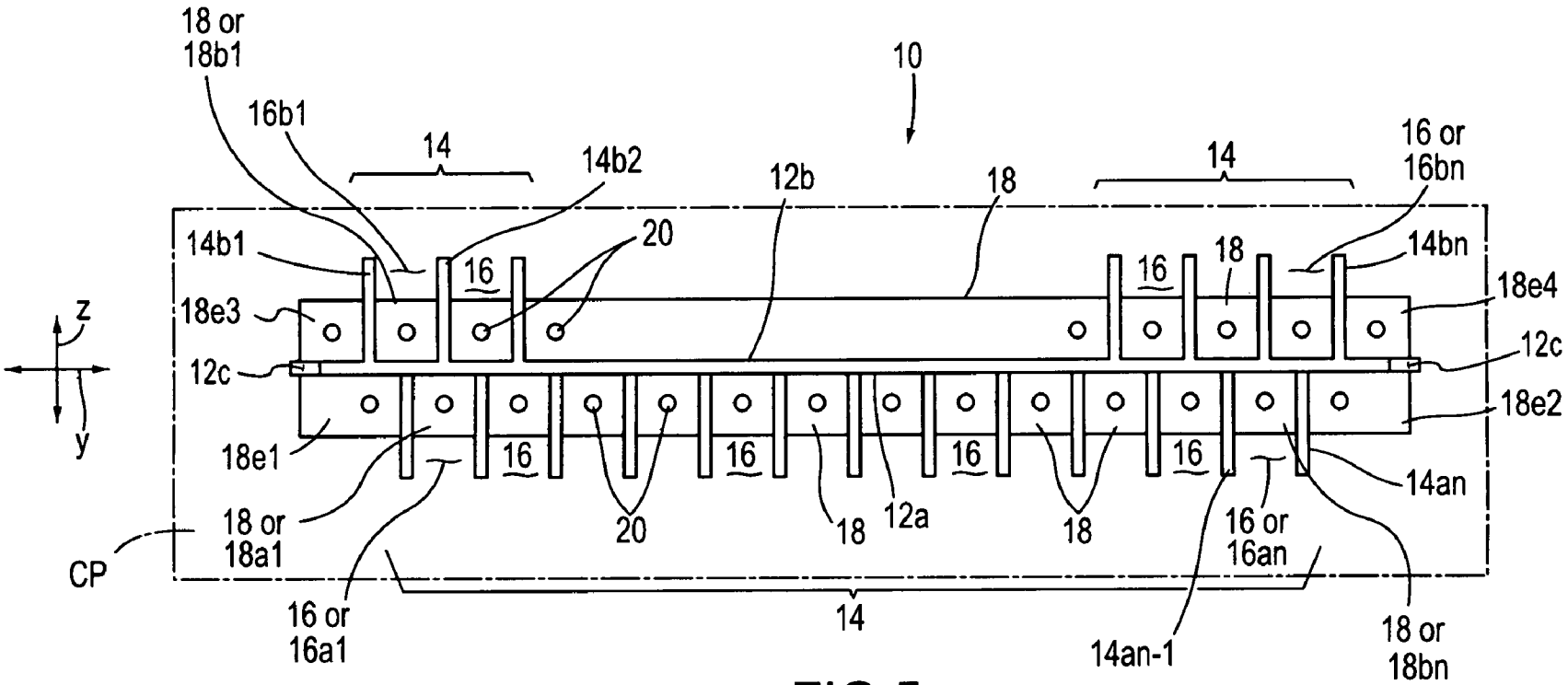
FIG. 5 is a top plan view of the first exemplary embodiment of the dielectric component of the present invention illustrated FIG. 1.
Figure 6:
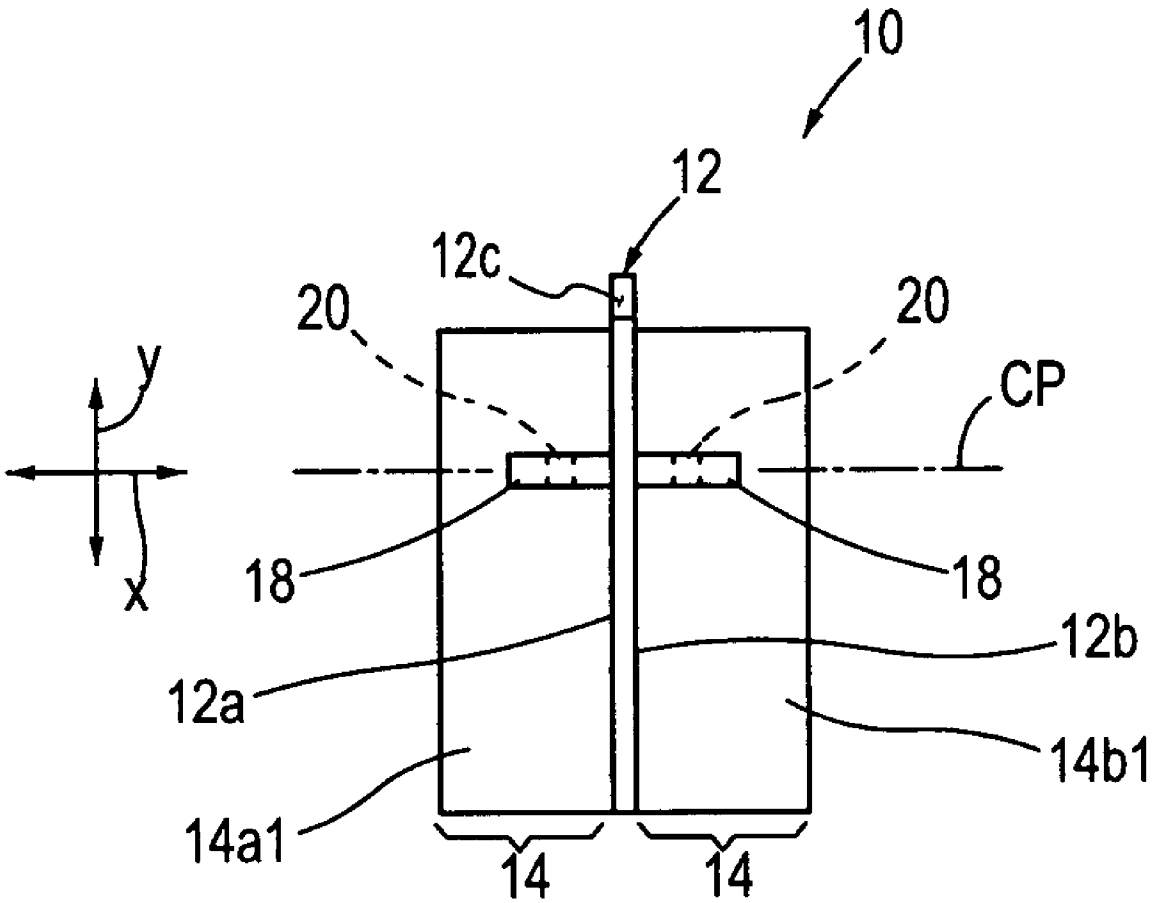
FIG. 6 is a right side elevational view of the first exemplary embodiment of the dielectric component of the present invention illus FIG. 1.

As best shown in FIGS. 1, 5 and 6, the plurality of isolation panel members 14, which are also fabricated from a dielectric material, are connected to and project perpendicularly from the first base panel member surface 12*a* and the second base panel member surface 12*b*. The plurality of isolation panel members 14 are disposed apart from one another and extend parallel to one another to form a plurality of isolation channels 16. Respective ones of the plurality of isolation channels 16 are defined between the base panel member 12 and consecutive ones of the plurality of isolation panel members 14, for instance, consecutive ones of isolation panel members 14*a*1 and 14*a*2 shown in FIG. 5.

With reference to FIGS. 1-6, the dielectric component 10 also includes a plurality of stop panel segments 18 fabricated from a dielectric material. Respective ones of the stop panel segments 18 are received by respective ones of the plurality of isolation channels 16 and are connected to the base panel member 12 and respective ones of the plurality of the isolation panel members 14. As particularly noted in FIGS. 4-6, respective ones of the stop panel segments 18 extend perpendicularly from the base panel member 12 as well as respective ones of the plurality of isolation panel members 14. Further, as illustrated in FIGS. 1 and 3-6, the plurality of stop panel segments 18 are disposed in a common plane CP. The common plane CP extends perpendicularly to the base panel member 12 as well as to the plurality of isolation panel members 14.

As shown in FIGS. 3-6, each one of the plurality of stop panel segments 18 includes a hole 20. The holes 20 of the plurality of stop panel segments extend though respective ones of the stop panel segments 18 in a y-direction shown in FIGS. 1 and 2 which is parallel to the plurality of isolation channels 16. By example only and not by way of limitation, the plurality of the stop panel segments 18, the base panel member 12, the plurality of isolation panel members 14 are connected to each other forming an integral construction as illustrated in FIGS. 1 and 3-6.

For the first exemplary embodiment of the dielectric component 10 of the present invention, the plurality of the isolation panel members 14 include a series of first isolation panel members 14*a*1-14*an* and a series of second isolation panel members 14*b*1-14*bn*. The series of first isolation panel members 14*a*1-14*an* project forwardly in the z-direction from the first base panel member surface 12*a* to form a series of first isolation channels 16*a*1-16*an*. The series of second isolation panel members 14*b*1-14*bn* project rearwardly from the second base panel member surface 12*b* to form a series of second isolation channels 16*b*1-16*bn*.

Additionally, for the first exemplary embodiment of the dielectric component 10, the plurality of stop panel segments 18 include a first series of stop panel segments 18*a*1-18*an* and a second series of stop panel segments 18*b*1-18*bn*. Respective ones of the first series of stop panel segments 18*a*1-18*bn* are received by respective ones of the series of first isolation channels 16*a*1-16*an*. Also, respective ones of the first series of stop panel segments 18*a*1-18*bn* are connected to the first base panel member surface 12*a* and to and between respective adjacent ones of the series of first isolation panel members 16*a*1-16*an*. Likewise, respective ones of the second series of stop panel segments 18*b*1-18*bn* are received by respective ones of the series of second isolation channels 14*b*1-14*bn* and are connected to the second base panel member surface 12*b* and to and between respective adjacent ones of the series of second isolation panel members 16*b*1-16*bn*.

As illustrated, respective ones of the first series of stop panel segments 18*a*1-18*an* extend perpendicularly from respective ones of the series of first isolation panel members 16*a*1-16*an* and the first base panel member surface 12*a* while respective ones of the second series of stop panel segments 18*b*1-18*bn* extend perpendicularly from respective ones of the series of second isolation panel members 16*b*1-16*bn* and the second base panel member surface 12*b*. With this arrangement, the first series of stop panel segments 18*a*1-18*an* and the second series of stop panel segments 18*b*1-18*bn* are disposed in the common plane CP which, in turn, extends perpendicularly to the base panel member 12 and respective ones of the series of the first isolation panel members 14*a*1-14*an* and the second isolation panel members 14*b*1-14*bn*. Each one of the stop panel segments 18 of the first series of stop panel segments 18*a*1-18*an* and the second series of stop panel segments 18*b*1-18*bn* include the hole 20 extending therethough as mentioned above.

As best shown in FIGS. 1 and 5, the series of first isolation panel members 14*a*1-14*an* has first isolation end panel members 14*a*1 and 14*an* and the series of second isolation panel members 14*b*1-14*bn* has second isolation end panel members 14*b*1 and 14*bn*. Also, the series of first isolation panel members 14*a*1-14*an* has first isolation intermediate panel members 14*a*2-14*an*-1 that are disposed between the first isolation end panel members 14*a*1 and 14*an* and the series of second isolation panel members 14*b*1-14*bn* has second isolation intermediate panel members 14*b*2-14*bn*-1 that are disposed between the second isolation end panel members 14*b*1 and 14*bn*. Furthermore, the dielectric component 10 includes a plurality of end stop panel segments 18*e*1-18*e*4 as best shown in FIG. 5. Each respective one of the plurality of end stop panel segments 18*e*1-18*e*4 are connected to a respective one of the end isolation panel members 14*a*1, 14*an*, 14*b*1 and 14*bn* and the base panel member. Also, each one of the end stop panel segments 18*e*1-18*e*4 include the hole 20 like the holes 20 that are formed in each one of the plurality of the stop panel segments 18.

Figure 7:
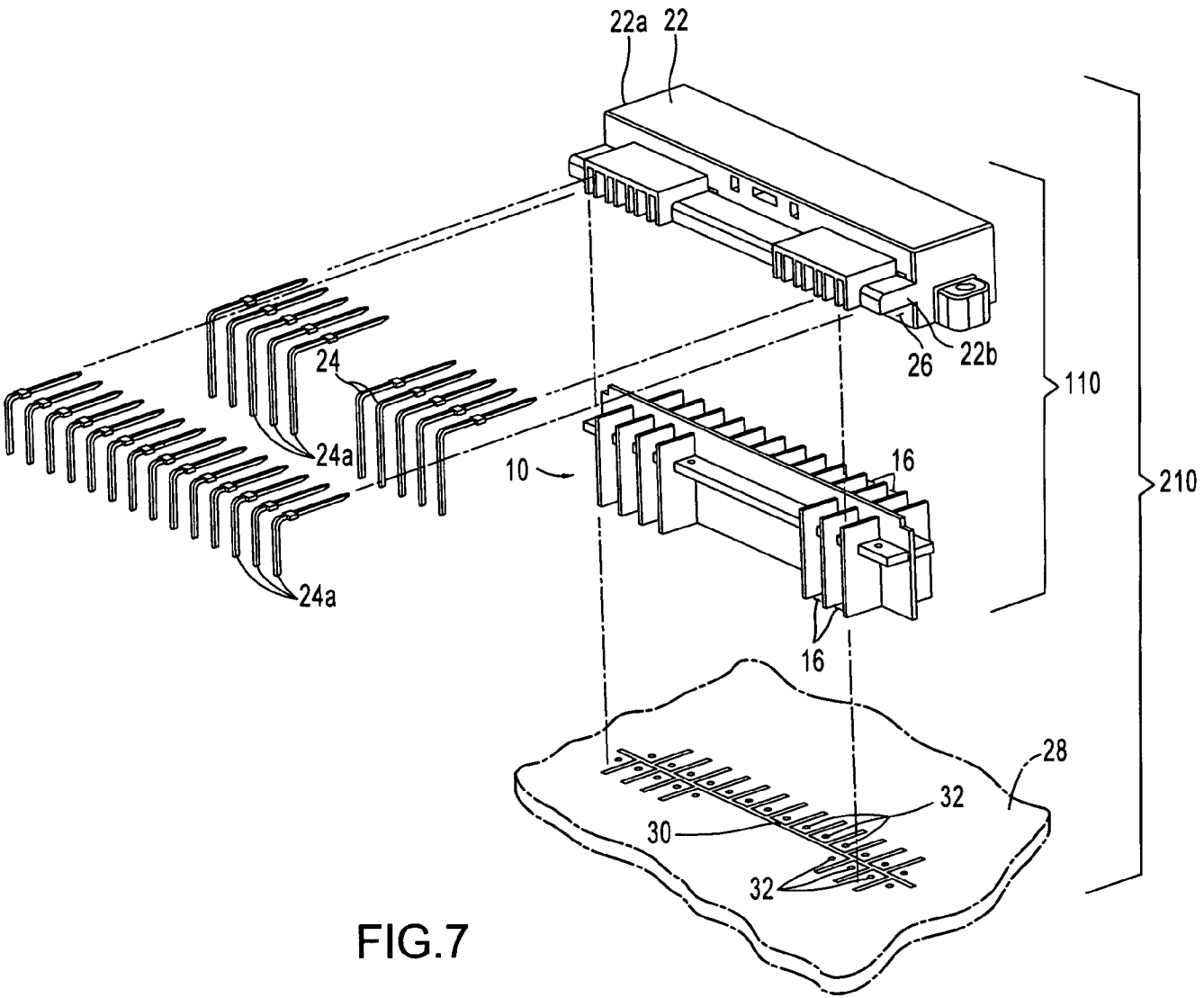
FIG. 7 is an exploded perspective view of a second exemplary embodiment of an electrical connector assembly incorporating the dielectric component illustrated in FIG. 1.
Figure 8:
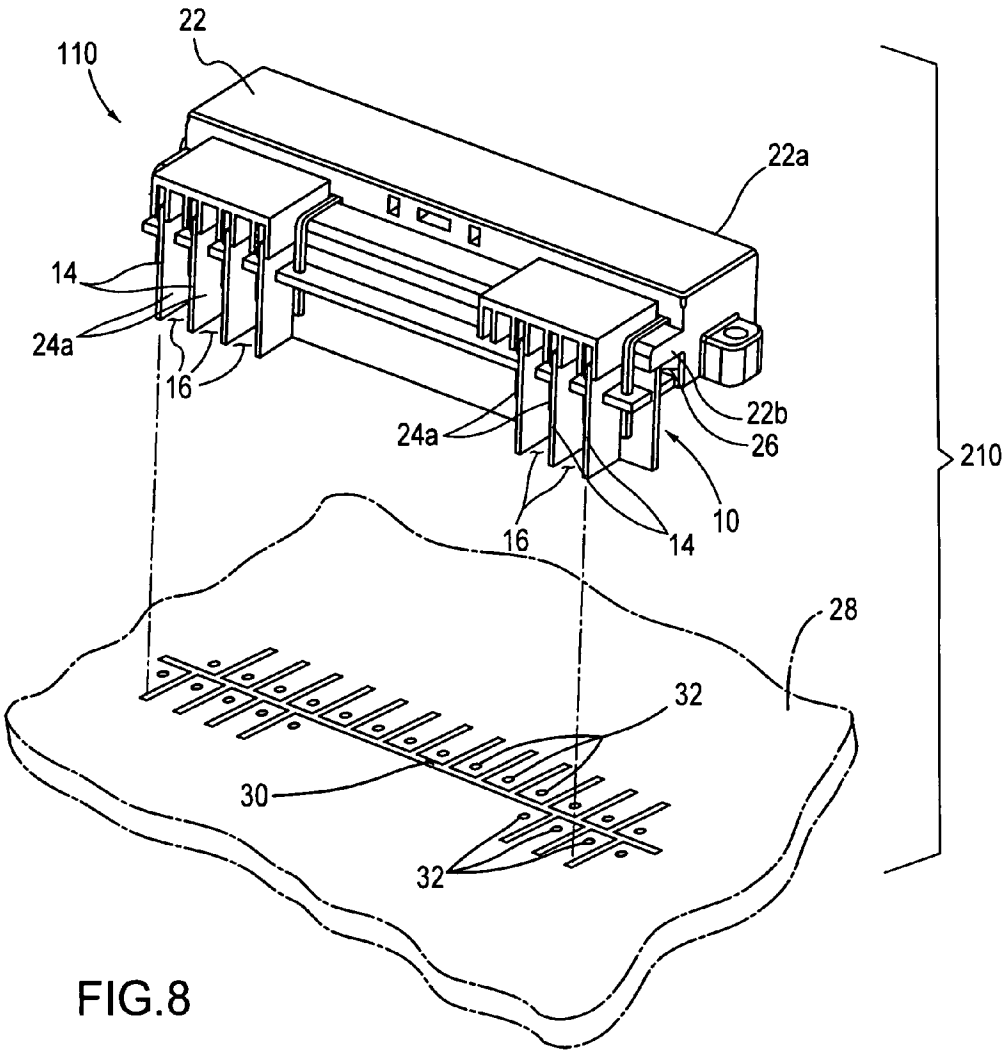
FIG. 8 is a partially-exploded perspective view of the second exemplary embodiment of the electrical connector assembly illustrated in FIG. 7 with the dielectric component in contact with an electrical connector housing.
Figure 9:
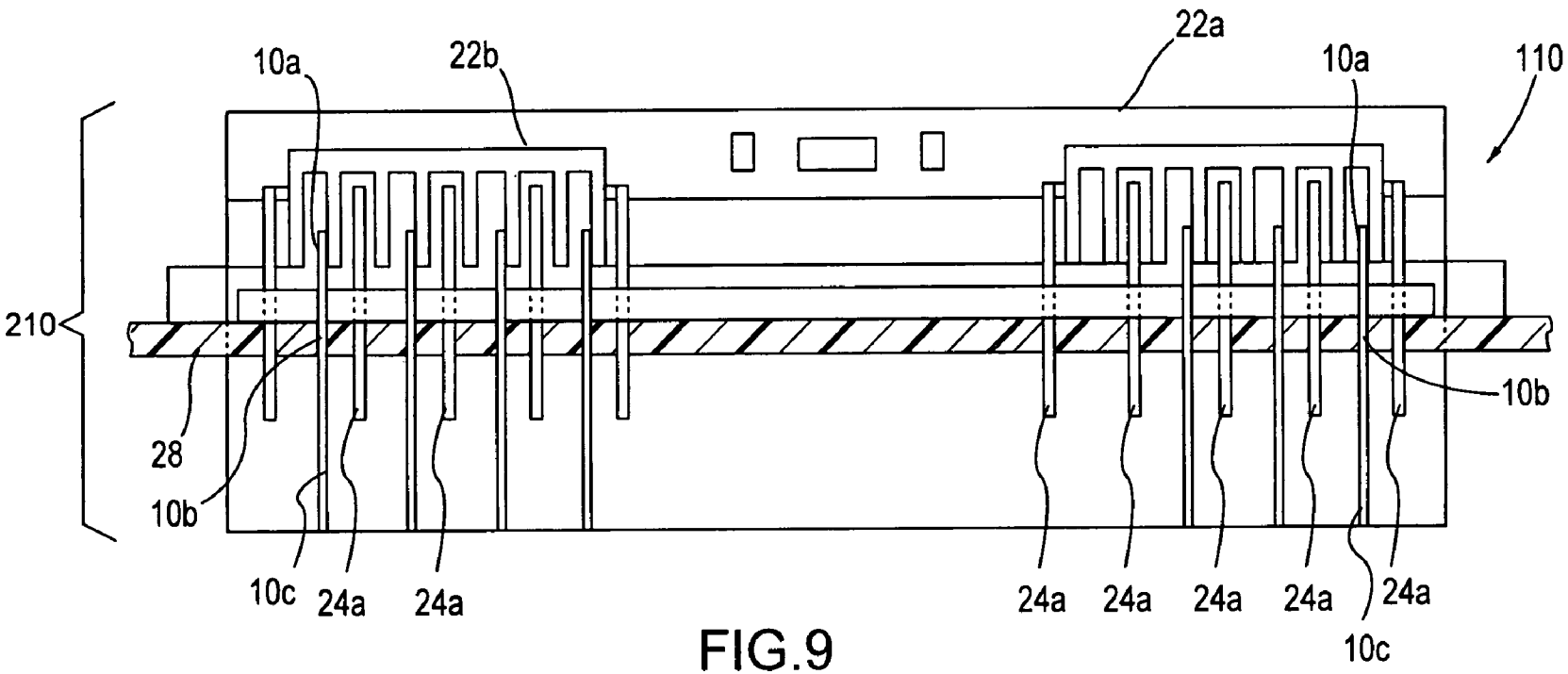
FIG. 9 is a front elevation view of the second exemplary embodiment of the electrical connector assembly illustrated in FIGS. 7 and 8 assembled onto a printed circuit board.
Figure 10:
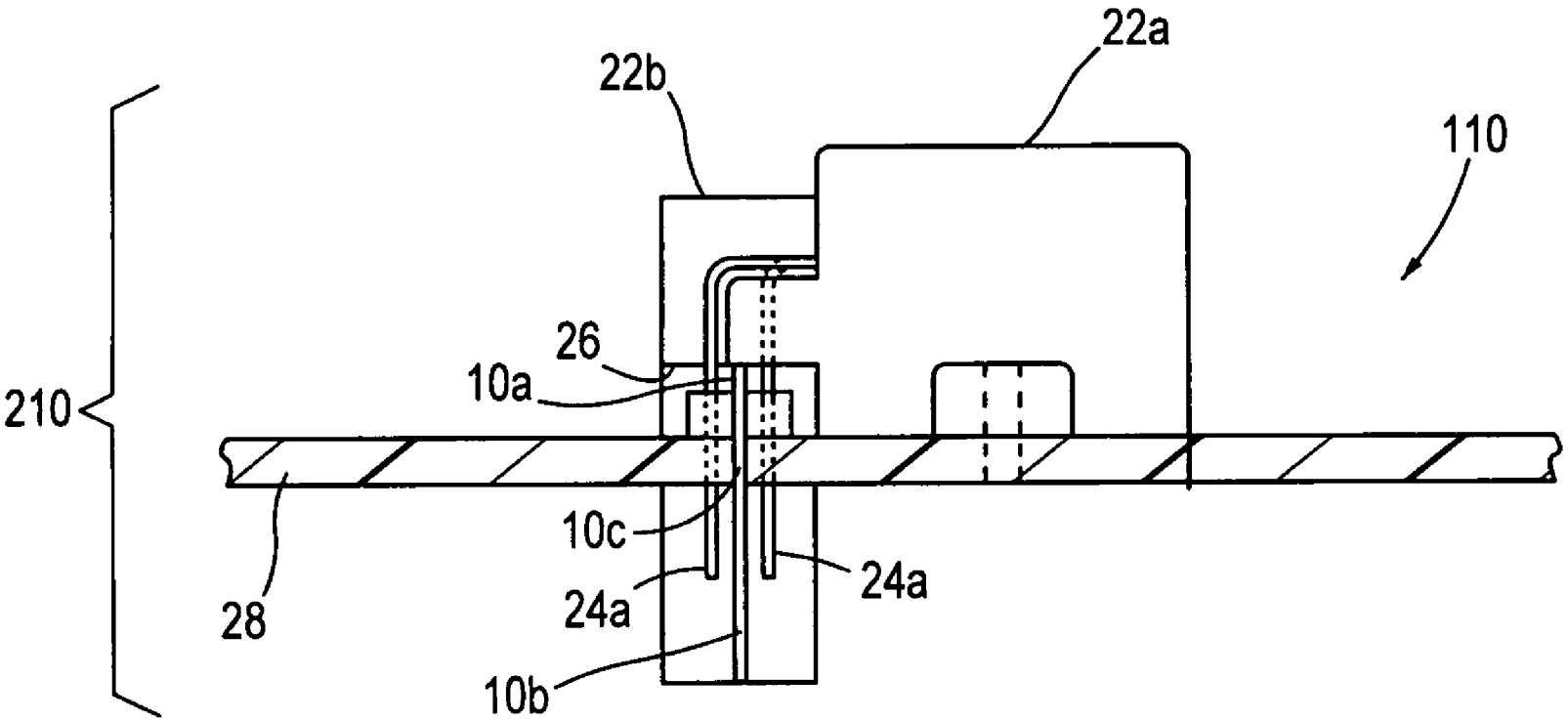
FIG. 10 is side elevation view of the second exemplary embodiment of the electrical connector assembly as shown in FIG. 9.
Figure 11:
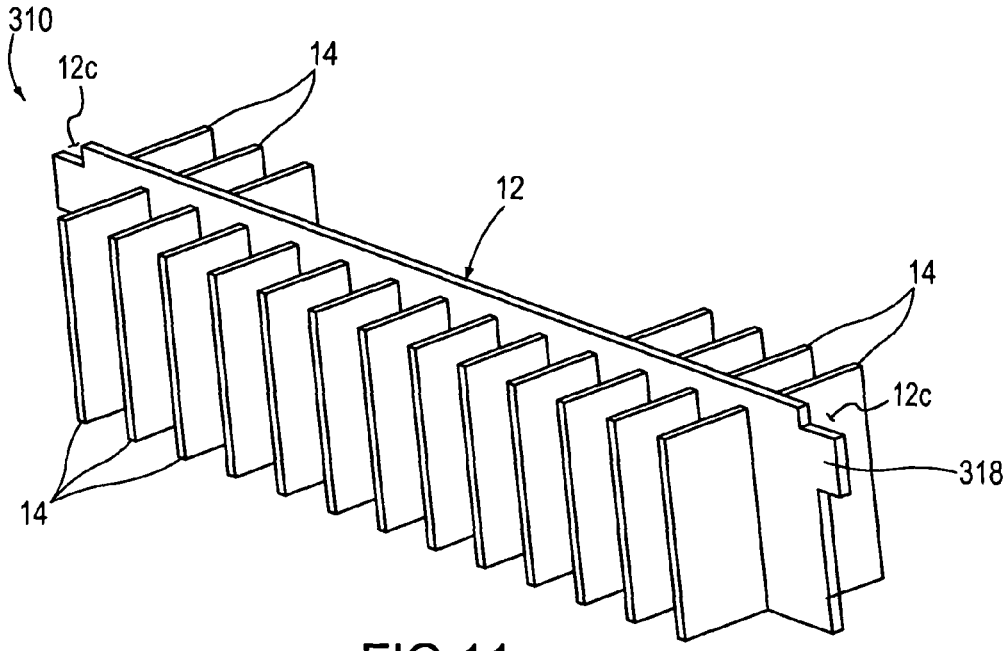
FIG. 11 is a perspective view of another exemplary embodiment of a dielectric component of the present invention.
Figure 12:
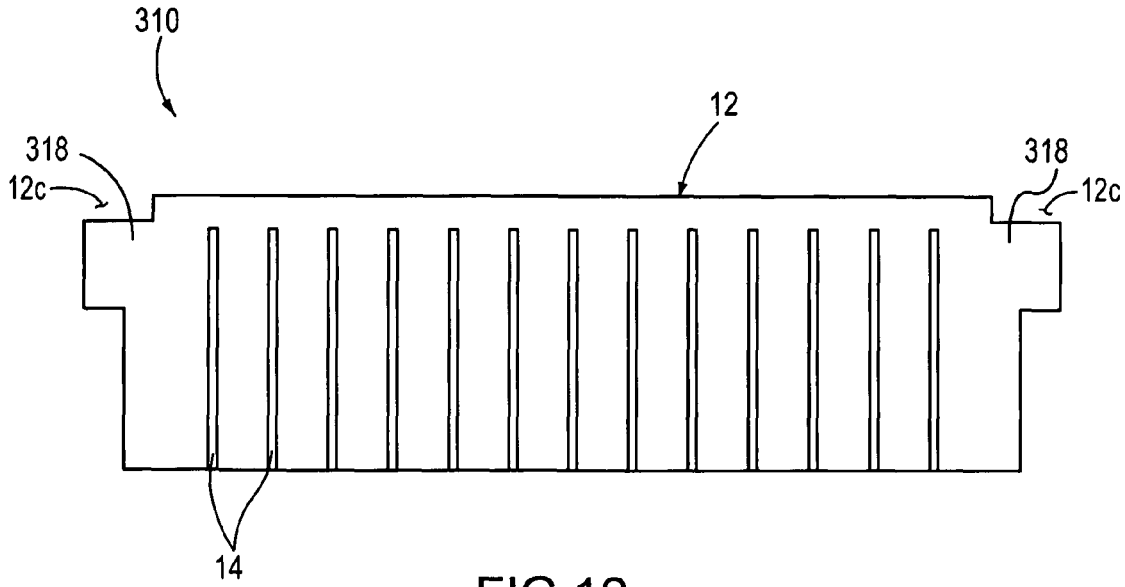
FIG. 12 is a front elevation view of the exemplary embodiment of the dielectric component of the present invention illustrated in FIG. 11.
Figure 13:
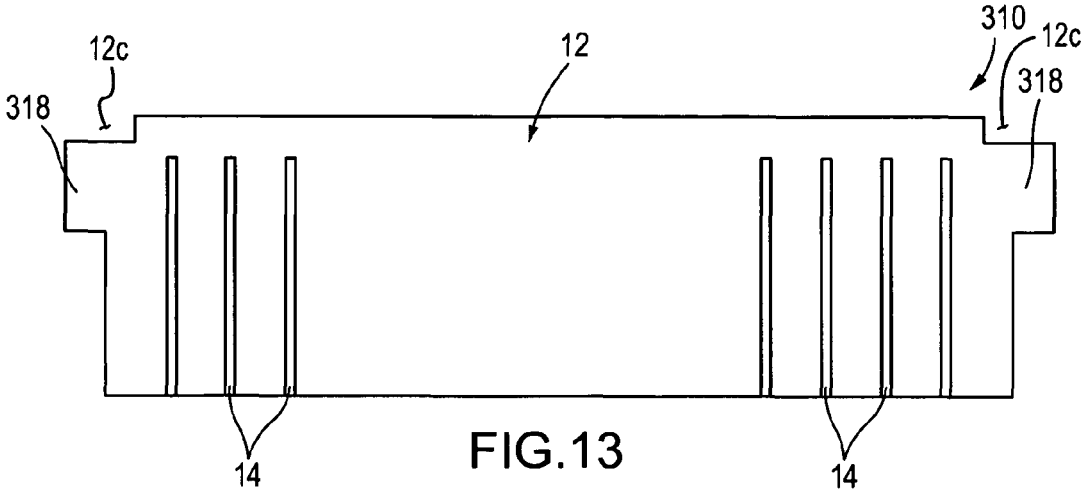
FIG. 13 is a rear elevation view of the exemplary embodiment of the dielectric component of the present invention illustrated in FIG. 11.
Figure 14:
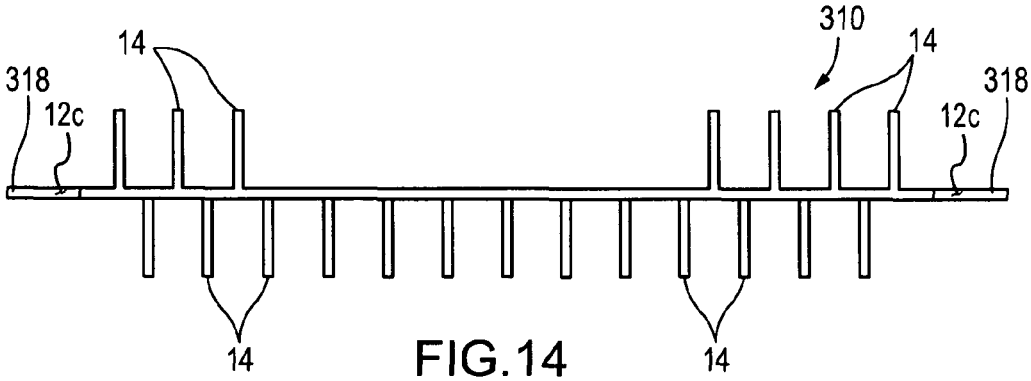
FIG. 14 is a top plan view of the exemplary embodiment of the dielectric component of the present invention illustrated in FIG. 11.
Figure 15:
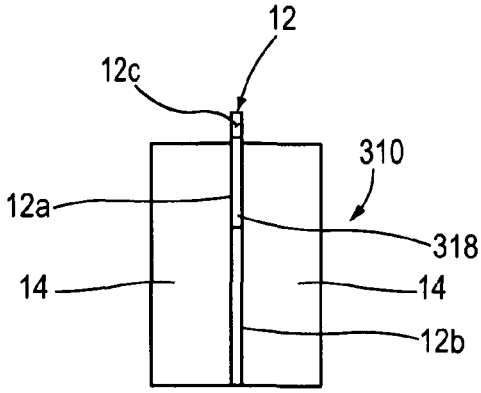
FIG. 15 is a right side elevational view of the exemplary embodiment of the dielectric component of the present invention illustrated in FIG. 11.

A second exemplary embodiment of an electrical connector assembly 110 of the present invention that incorporates the dielectric component 10 is introduced in FIGS. 7-10. The electrical connector assembly 110 includes a male electrical connector housing 22 and the dielectric component 10. The male electrical connector housing 22 has a plurality of terminal pins 24 secured therein as is known in the art. Each terminal pin 24 has a terminal pin portion 24*a* projecting from the male electrical connector housing 22. The plurality of terminal pins 24 are arranged in a manner that, when the male electrical connector housing 22 and the dielectric component 10 contact each other as shown in FIGS. 8-10, respective ones of the terminal pin portions 24*a* are received in respective ones of the plurality of isolation channels 16 and, in turn, consecutive ones of the terminal pin portions 24*a* are isolated from one another by consecutive ones of the plurality of isolation panel members 14 which are disposed between the consecutive ones of the plurality of the terminal pin portions 24*a*. If the plurality of stop panel segments 18 are used, one of ordinary skill in the art would appreciate that the holes 20 are arranged in a pattern to slidably receive respective ones of the terminal pin portions 24*a*.

As best shown in FIGS. 7 and 10, the male electrical connector housing 22 includes a main housing part 22*a* and an adjunct housing part 22*b* extending from the main housing part 22*a* to form a notch 26 as best shown in FIGS. 7, 8 and 10. From the notch 26, at least some of the terminal pin portions 24*a* extend therethrough. The notch 26 is sized to receive at least a portion of the dielectric component 10.

A third exemplary embodiment of an electrical connector assembly 210 is also illustrated in FIGS. 7-10. The electrical connector assembly 210 includes the components of the electrical connector assembly 110 and also includes a printed circuit board 28 as shown in FIGS. 7 and 8. The printed circuit board 28 includes a pair of electrical connector assembly holes 34, a dielectric component hole 30 and a plurality of terminal pin holes 32 formed therethrough. The dielectric component hole 30 is sized and is configured to slidably receive the base panel member 12 and the plurality of isolation panel members 14 in an insertion direction, i.e, the direction of the y axis. Respective ones of the plurality of terminal pin holes 32 are sized and arranged to slidably receive respective ones of the terminal pin portions 24*a*.

With the dielectric component 10 being slidably received by the dielectric component hole 30 and the plurality of terminal pin portions 24*a* being slidably received by respective ones of the plurality terminal pin holes 32, the plurality of stop panel segments 18 contact the printed circuit board 28. One of ordinary skill in the art would appreciate that the dielectric component 10 is inserted through the dielectric component hole 30 formed in the printed circuit board 28 and, when the plurality of stop panel segments 18 contact the printed circuit board 28, insertion of the dielectric component 10 through the dielectric component hole 30 can no longer proceed. In short, insertion stops by virtue of the plurality of stop panel segments 18 contacting the printed circuit board 28. Thus, the dielectric component 10 rests in a stationary state on the printed circuit board 28. In this manner, a first part 10*a* of the dielectric component 10 projects from one side of the printed circuit board 28, a second part 10*b* of the dielectric component 10 projects from an opposite side of the printed circuit board 28 and a third part 10*c* of the dielectric component 10 being disposed between the first part 10*a* and the second part 10*b* of the dielectric component 10 is surrounded by the printed circuit board 28.

Figure 16:
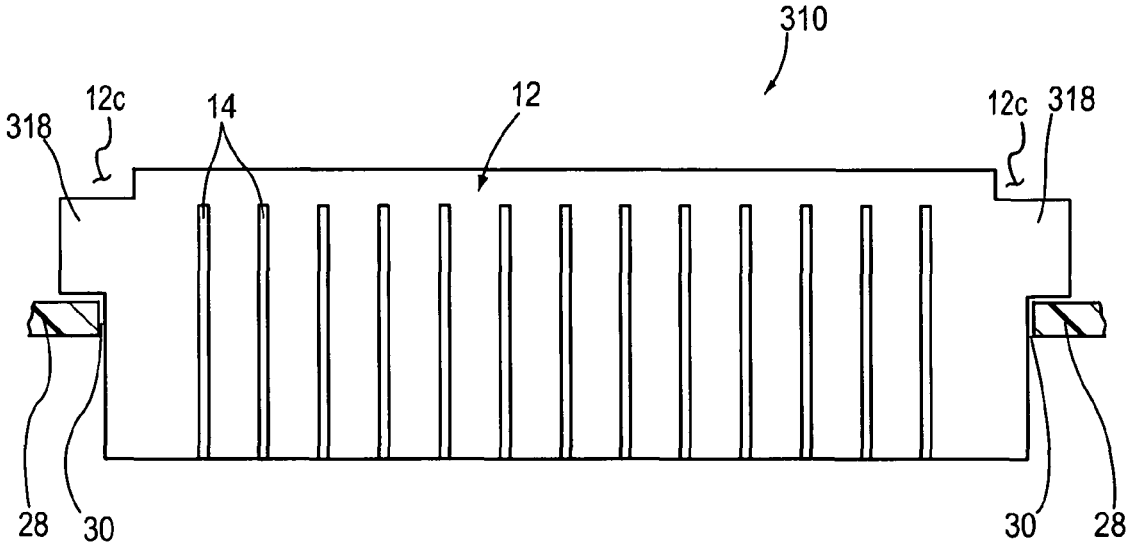
FIG. 16 is a front elevation view of the exemplary embodiment of the dielectric component of the present invention illustrated in FIG. 11 and shown resting on a printed circuit board.
Figure 17:
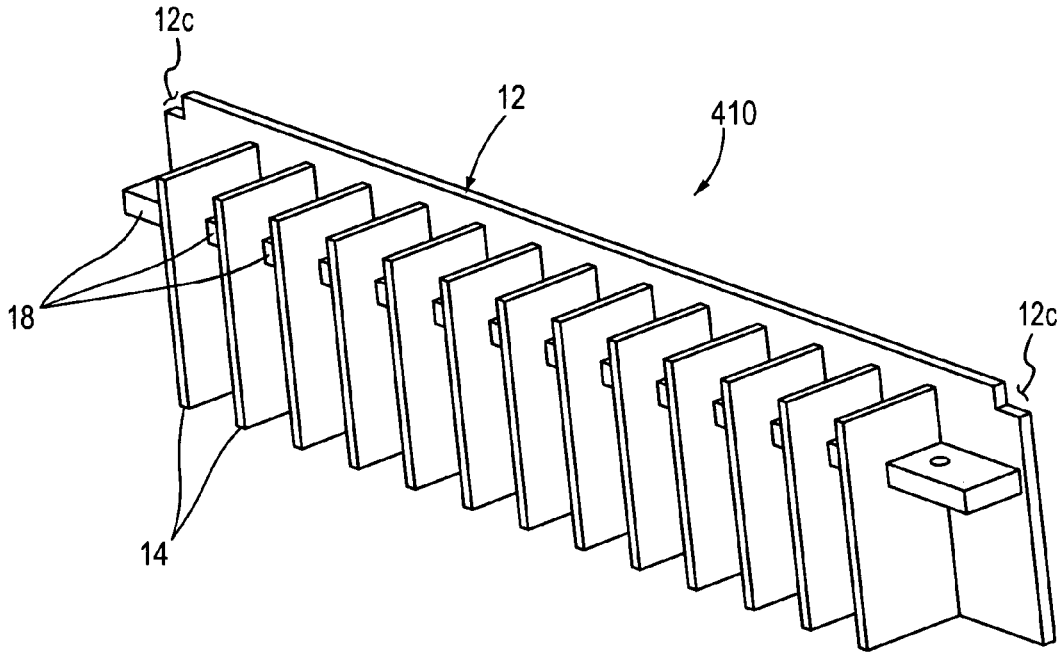
FIG. 17 is a perspective view of yet another exemplary embodiment of a dielectric component of the present invention.
Figure 18:
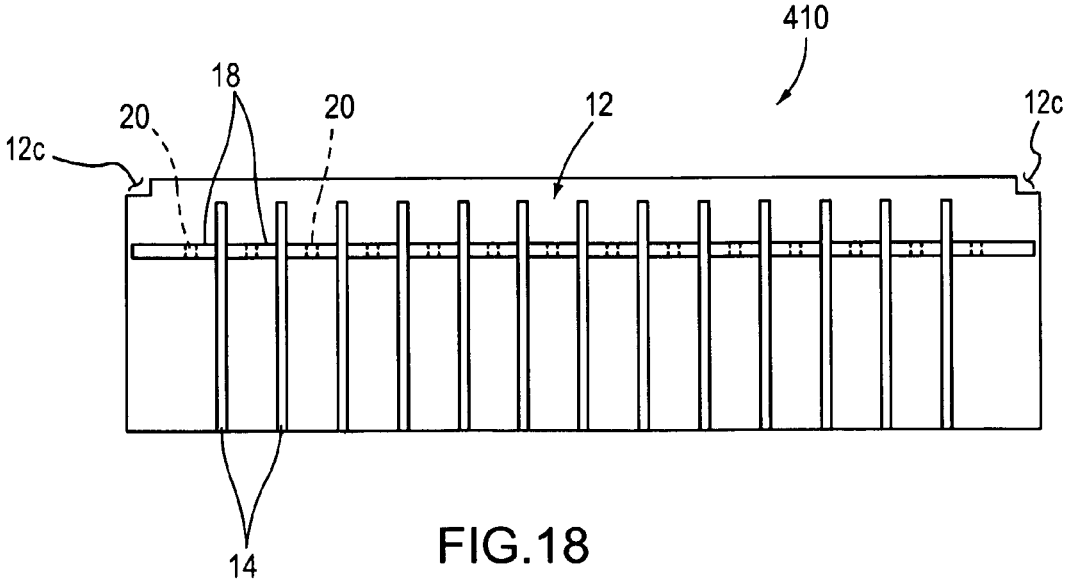
FIG. 18 is a front elevation view of the exemplary embodiment of the dielectric component of the present invention illustrated in FIG. 17.
Figure 19:
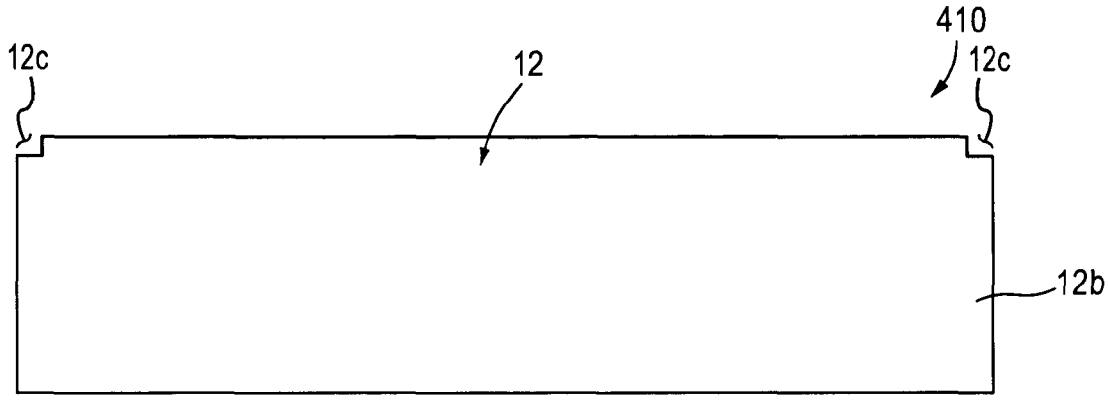
FIG. 19 is a rear elevation view of the exemplary embodiment of the dielectric component of the present invention illustrated in FIG. 17.
Figure 20:
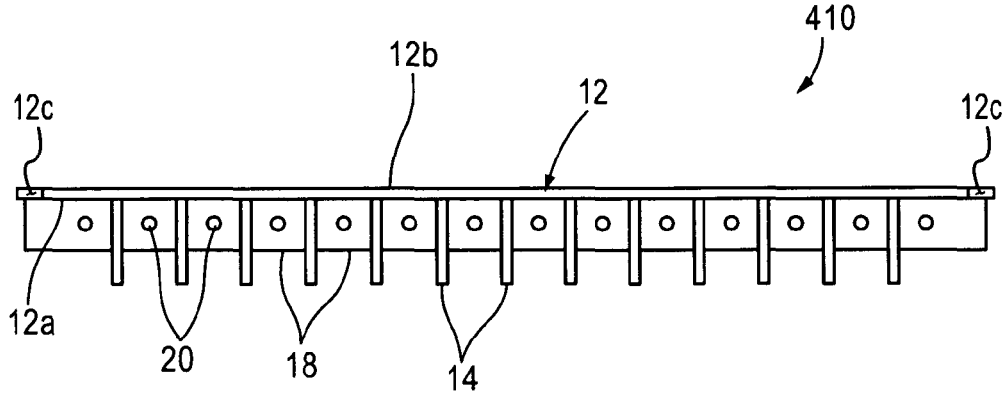
FIG. 20 is a top plan view of the exemplary embodiment of the dielectric component of the present invention illustrated in FIG. 17.
Figure 21:
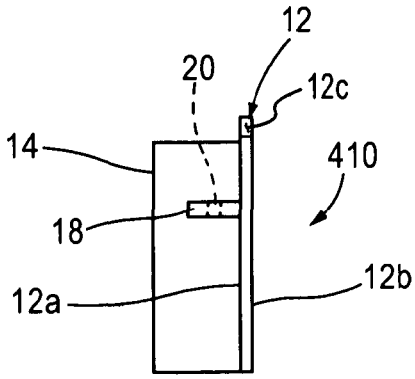
FIG. 21 is a right side elevational view of the exemplary embodiment of the dielectric component of the present invention illustrated in FIG. 17.

A fourth exemplary embodiment of a dielectric component 310 of the present invention is illustrated in FIGS. 11-16. The dielectric component 310 of the present invention is similar to the dielectric component 10 of the present invention discussed above. One difference is that a pair of stop panel segments 318 are integrally formed on respective lateral sides of the base panel member 12. As best shown in FIG. 16, the pair of stop panel segments 318 contact the printed circuit board 28 to stop further insertion of the dielectric component 310 through the dielectric component hole 30 formed into the printed circuit board 28. Note that the dielectric component 310 is absent of any other stop panel segments, namely stop panel segments 18*a*1-18*an*, 18*b*1-18*bn* and 18*e*1-18*e*4 as described above.

A fifth exemplary embodiment of a dielectric component 410 of the present invention is illustrated in FIGS. 17-21. The dielectric component 410 of the present invention is similar to the dielectric component 10 of the present invention discussed above. A difference is that the dielectric component 410 is absent of any isolation panel members, namely 14*b*1-14*bn* isolation panel members, and associated ones of the stop panel segments, namely stop panel segments 18*b*1-18*bn* and 18*e*1-18*e*4, as described above, that are connected to the second base panel member surface 12*b*. However, one of ordinary skill in the art would appreciate that, in lieu of the isolation panel members and stop elements being connected to the first base panel member surface, the isolation panel members and the stop panel segments might be connected to the second base panel member surface. Thus, the isolation panel members and the stop panel segments are connected to and project perpendicularly from at least one of the first base panel member and the second base panel member surface.

Figure 22:
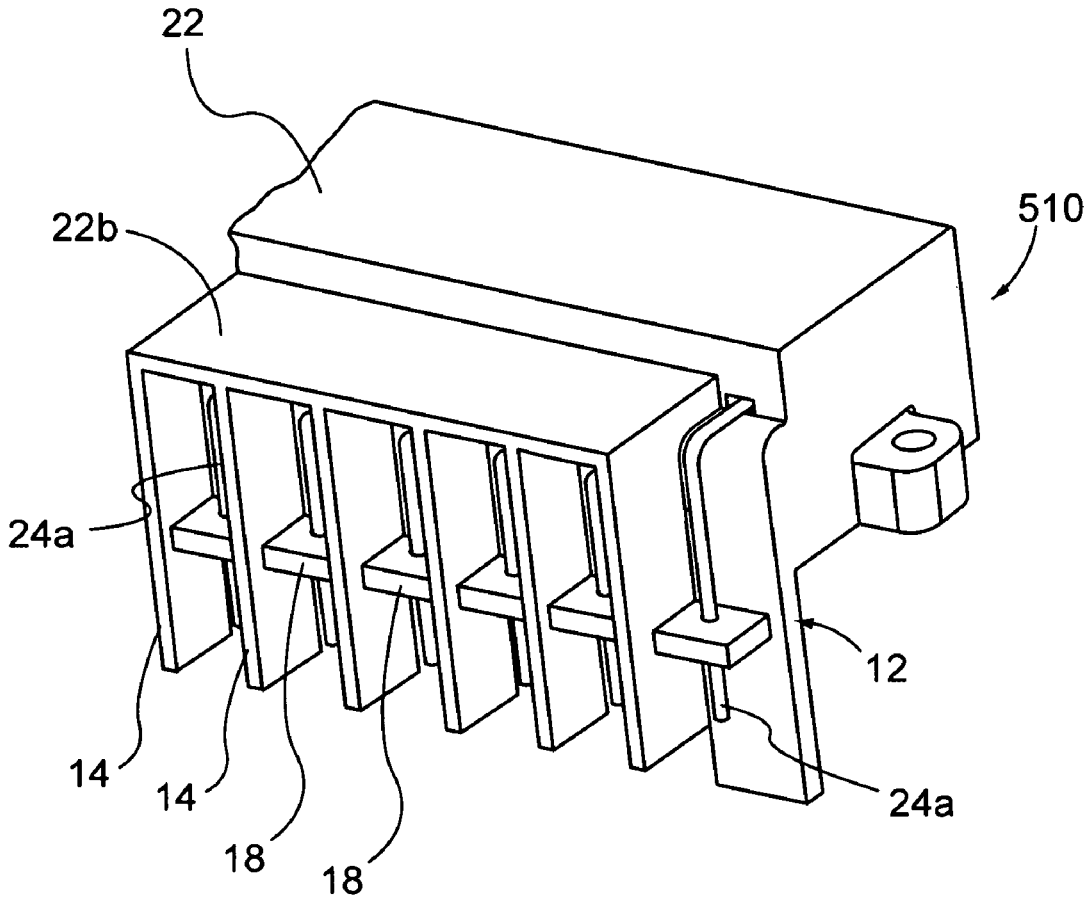
FIG. 22 is a perspective view of another exemplary embodiment illustrating a dielectric component of the present invention incorporated with an electrical connector housing as an integral construction.

A sixth exemplary embodiment of a dielectric component 510 of the present invention is illustrated in FIG. 22. For the sixth exemplary embodiment of the dielectric component 51 of the present invention, the male electrical connector housing 22, the base panel member 12, the plurality of isolation panel members 14 and the plurality of the stop panel segments 18 are connected together to form an integral construction.

The present invention, may, however, be embodied in various different forms and should not be construed as limited to the exemplary embodiments set forth herein; rather, these exemplary embodiments are provided so that this disclosure will be thorough and complete and will fully convey the scope of the present invention to those skilled in the art. For example, although the exemplary embodiments of the present invention illustrate a male electrical connector housing, one of ordinary skill in the art would appreciate that the dielectric component might be incorporated with a female electrical connector housing. Also, the dielectric component might also be fabricated from a dielectric material that is compressible such as a stiff yet resilient material like rubber. Further, in addition to the shape of the electrical connector housing described herein, other shapes and types of electrical connector housings might be employed with the present invention.

What is claimed is:

1. A dielectric component, comprising:

a base panel member fabricated from a dielectric material and comprising a first base panel member surface and an opposite second base panel member surface extending parallel to the first base panel member surface;

a plurality of isolation panel members fabricated from a dielectric material and connected to and projecting perpendicularly from at least one of the first base panel member surface and the second base panel member surface, the plurality of isolation panel members being disposed apart from and extending parallel to one another to form a plurality of isolation channels, respective ones of the plurality of isolation channels being defined between the base panel member and consecutive ones of the plurality of isolation panel members; and a plurality of stop panel segments being connected to at least the base panel member, wherein respective ones of the stop panel segments are received by respective ones of the plurality of isolation channels and are connected to the base panel member and respective ones of the plurality of the isolation panel members.

2. The dielectric component according to claim 1, wherein respective ones of the stop panel segments extend perpendicularly from the base panel member and respective ones of the plurality of isolation panel members.

3. The dielectric component according to claim 2, wherein the plurality of stop panel segments are disposed in a common plane extending perpendicularly to the base panel member and the plurality of isolation panel members.

4. The dielectric component according to claim 3, wherein each one of the plurality of stop panel segments includes a hole extending therethough in a direction parallel to the plurality of isolation channels.

5. The dielectric component according to claim 4, wherein the base panel member, the plurality of isolation panel members and the plurality of the stop panel segments are connected together to form an integral construction.

6. The dielectric component according to claim 1, wherein the plurality of the isolation panel members include a series of first isolation panel members and a series of second isolation panel members, the series of first isolation panel members projecting forwardly from the first base panel member surface to form a series of first isolation channels, the series of second isolation panel members projecting rearwardly from the second base panel member surface to form a series of second isolation channels.

7. The dielectric component according to claim 6, further comprising:

a first series of stop panel segments and a second series of stop panel segments, respective ones of the first series of stop panel segments being received by respective ones of the series of first isolation channels and are connected to the first base panel member surface and to and between respective adjacent ones of the series of first isolation panel members, respective ones of the second series of stop panel segments being received by respective ones of the series of second isolation channels and are connected to the second base panel member surface and to and between respective adjacent ones of the series of second isolation panel members.

8. The dielectric component according to claim 7, wherein respective ones of the first series of stop panel segments extend perpendicularly from respective ones of the series of first isolation panel members and the first base panel member surface and respective ones of the second series of stop panel segments extend perpendicularly from respective ones of the series of second isolation panel members and the second base panel member surface.

9. The dielectric component according to claim 8, wherein the first series of stop panel segments and the second series of stop panel segments are disposed in a common plane extending perpendicularly to the base panel member and respective ones of the series of the first and second isolation panel members, each one of the stop panel segments of the first series of stop panel segments and the second series of stop panel segments include a hole extending therethough, each one of the holes extending parallel to the plurality of isolation channels.

10. An electrical connector assembly, comprising:

an electrical connector housing having a plurality of terminal pins secured therein with each terminal pin comprising a terminal pin portion projecting from the electrical connector housing; and a dielectric component being in contact with the electrical connector housing and including:

a base panel member fabricated from a dielectric material and having a first base panel member surface and an opposite second base panel member surface extending parallel to the first base panel member surface;

a plurality of isolation panel members fabricated from a dielectric material and connected to and projecting perpendicularly from at least one of the first base panel member and the second base panel member surface, the plurality of isolation panel members being disposed apart from and extending parallel to one another to form a plurality of isolation channels, respective ones of the plurality of isolation channels being defined between the base panel member and consecutive ones of the plurality of isolation panel members, and a plurality of stop panel segments being connected to at least the base panel member, wherein the plurality of terminal pins are arranged in a manner that, when the electrical connector housing and the dielectric component contact each other, respective ones of the terminal pin portions are received in respective ones of the plurality of isolation channels with consecutive ones of the terminal pin portions being isolated from one another by consecutive ones of the plurality of isolation panel members disposed therebetween, wherein the electrical connector housing includes a main housing part and an adjunct housing part extending from the main housing part to form a notch from which at least some of the terminal pin portions extend, the notch sized to receive at least a portion of the dielectric component.

11. The electrical connector assembly according to claim 10, wherein respective ones of the stop panel segments are received by respective ones of the plurality of isolation channels and are connected to the base panel member and respective ones of the plurality of the isolation panel members, respective ones of the stop panel segments extend perpendicularly from the base panel member and respective ones of the plurality of isolation panel members and are disposed in a common plane extending perpendicularly to the base panel member and the plurality of isolation panel members, each one of the plurality of stop panel segments includes a hole extending therethough in a direction parallel to the plurality of isolation channels, respective ones of the holes are sized to slidably receive respective ones of the terminal pin portions therethrough.

12. The electrical connector assembly according to claim 11, wherein the electrical connector housing, the base panel member, the plurality of isolation panel members and the plurality of the stop panel segments are connected together to form an integral construction.

13. The electrical connector assembly according to claim 11, wherein the plurality of the isolation panel members include a series of first isolation panel members and a series of second isolation panel members, the series of first isolation panel members projecting forwardly from the first base panel member surface to form a series of first isolation channels, the series of second isolation panel members projecting rearwardly from the second base panel member surface to form a series of second isolation channels.

14. The electrical connector assembly according to claim 13, wherein the plurality of stop elements includes a first series of stop panel segments and a second series of stop panel segments, respective ones of the first series of stop panel segments being received by respective ones of the series of first isolation channels and are connected to the first base panel member surface and to and between respective adjacent ones of the series of first isolation panel members, respective ones of the second series of stop panel segments being received by respective ones of the series of second isolation channels and are connected to the second base panel member surface and to and between respective adjacent ones of the series of second isolation panel members.

15. The electrical connector assembly according to claim 14, wherein respective ones of the first series of stop panel segments extend perpendicularly from respective ones of the series of first isolation panel members and the first base panel member surface and respective ones of the second series of stop panel segments extend perpendicularly from respective ones of the series of second isolation panel members and the second base panel member surface, the first series of stop panel segments and the second series of stop panel segments are disposed in a common plane extending perpendicularly to the base panel member and respective ones of the series of the first and second isolation panel members.

16. An electrical connector assembly, comprising:

a printed circuit board;

an electrical connector housing having a plurality of terminal pins secured therein with each terminal pin having a terminal pin portion projecting from the electrical connector housing; and a dielectric component being in contact with the electrical connector housing and including:

a base panel member fabricated from a dielectric material and having a first base panel member surface and an opposite second base panel member surface extending parallel to the first base panel member surface;

a plurality of isolation panel members fabricated from a dielectric material and connected to and projecting perpendicularly from at least one of the first base panel member and the second base panel member surface, the plurality of isolation panel members being disposed apart from and extending parallel to one another in an insertion direction to form a plurality of isolation channels, respective ones of the plurality of isolation channels being defined between the base panel member and consecutive ones of the plurality of isolation panel members, and a plurality of stop panel segments being connected to at least the base panel member, wherein the plurality of terminal pins are arranged in a manner that, when the electrical connector housing and the dielectric component contact each other, respective ones of the terminal pin portions are received in respective ones of the plurality of isolation channels with consecutive ones of the terminal pin portions being isolated from one another by consecutive ones of the plurality of isolation panel members disposed therebetween, wherein the printed circuit board includes a dielectric component hole and a plurality of terminal pin holes formed therethrough, the dielectric component hole sized and configured to slidably receive the base panel member and the plurality of isolation panel members in the insertion direction, respective ones of the plurality of terminal pin holes sized and arranged to slidably receive respective ones of the terminal pin portions, and wherein, with the dielectric component being slidably received by the dielectric component hole and the plurality of terminal pin portions being slidably received by respective ones of the plurality terminal pin holes, the plurality of stop panel segments contact the printed circuit board so that the dielectric component rests on the printed circuit board such that a first part of the dielectric component projects from one side of the printed circuit board, a second part of the dielectric component projects from an opposite side of the printed circuit board and a third part of the dielectric component disposed between the first and second parts of the dielectric component is surrounded by the printed circuit board.

17. The electrical connector assembly according to claim 16, wherein the plurality of stop panel segments are connected to at least the base panel member.

18. The electrical connector assembly according to claim 17, wherein respective ones of the stop panel segments are received by respective ones of the plurality of isolation channels and are connected to the base panel member and respective ones of the plurality of the isolation panel members, respective ones of the stop panel segments extend perpendicularly from the base panel member and respective ones of the plurality of isolation panels and are disposed in a common plane extending perpendicularly to the base panel member and the plurality of isolation panel members.

* * * * *